US005332211A

United States Patent [19]

Rife et al.

[11] Patent Number: 5,332,211

[45] Date of Patent: Jul. 26, 1994

[54] DEVICE FOR PRACTICING PUTTING AND CHIPPING STROKES

[76] Inventors: Guerin D. Rife, 1230 Via Salerno, Winter Park, Fla. 32789; Michael D. Bentley, 2428 Lake Vista Ct., Unit 300, Casselberry, Fla. 32707; David B. N. Leadbetter, 9100 Chiltern Dr., Orlando, Fla. 32827

[21] Appl. No.: 35,306

[22] Filed: Mar. 22, 1993

[51] Int. Cl.[5] ..... A63B 69/36

[52] U.S. Cl. ..... 273/187.6; 273/192; 273/35 A; 273/187.1; 273/DIG. 21

[58] Field of Search ..... 273/191 R, 191 A, 191 B, 273/192, 187.6, 187.1, 187 R, 35 A, DIG. 21

[56] References Cited

U.S. PATENT DOCUMENTS

| | | | |
|---|---|---|---|
| 1,567,530 | 12/1925 | MacNaughton et al. | 273/191 A |
| 2,776,836 | 1/1957 | Zadina | 273/192 |
| 3,912,277 | 10/1975 | Pelz . | |
| 3,934,874 | 1/1976 | Henderson | 273/35 A |
| 3,953,035 | 4/1976 | Beckisk . | |
| 4,071,251 | 1/1978 | Beckish | 273/191 A |
| 4,082,287 | 4/1978 | Berkey . | |
| 4,230,319 | 10/1980 | Lindner . | |
| 4,323,246 | 4/1982 | Nehrbas, Jr. . | |
| 4,423,875 | 1/1984 | Miller . | |
| 4,437,669 | 3/1984 | Pelz . | |
| 4,693,570 | 9/1987 | Kryder . | |
| 4,900,030 | 2/1990 | Houtz . | |
| 4,928,975 | 5/1990 | Skelley et al. . | |

*Primary Examiner*—George J. Marlo
*Attorney, Agent, or Firm*—Julian C. Renfro

[57] ABSTRACT

A simulator enabling a golfer to practice his putting skills and at the same time become more aware of the optimum motion of his shoulders and arms during a putting effort. This simulator comprises an elongate guide plane of flexible material having a mid portion as well as end portions, and also having an active edge, along which a lower portion of the shaft of a putter may pass during efforts by the golfer to putt a golf ball into a nearby cup. Components are used for supporting the guide plane in a desired relationship to a playing surface, such components being heightwise adjustable, so as to enable the individual heights of the mid and end portions of the guide plane above the playing surface to be independently adjusted, which at the same time determines the positioning of the active edge with respect to the playing surface. Used with this simulator is an eye alignment mirror containing indicia thereon enabling the lineup of the active edge of the guide plane in a parallel relationship to the target line to the cup.

13 Claims, 5 Drawing Sheets

DEVICE FOR PRACTICING PUTTING AND CHIPPING STROKES

TECHNICAL FIELD

This invention relates generally to a device for enabling a golfer to practice putting, and more particularly to a golf training device having sufficient adjustments as to be usable by golfers having widely differing putting techniques.

This invention has a secondary application as a device enabling a golfer to practice his or her short chipping technique.

BACKGROUND OF THE INVENTION

The importance of putting to a golfer cannot be minimized inasmuch as about half of the strokes taken in a round of golf are putts. Seemingly, the golf putting stroke should be relatively easy to execute, but most golfers do not find such to be the case.

Preparatory to executing a putt a golfer must survey that portion of the green located between his or her ball and the cup to determine which way the ball will curve or "break," to establish whether the course of travel is uphill or downhill, and to ascertain the magnitude of such terrain deviations from a level surface. Once this is done the golfer merely has to stroke the ball in a predetermined direction with sufficient force for the ball to roll into the cup. However, this is far easier to say than to accomplish.

Heretofore, certain physical aids have been devised for use in training golfers to putt. Some prior art aids proposed or actually developed for use in enhancing a golfer's ability to putt have comprised a track having a pair of spaced, parallel guides between which one swings the putter head. Deviations in movement of the head between the two guides are sensed visually or by contact of the putter head with one of the guides. Exemplary of such putting aids are those shown in U.S. Pat. Nos. 4,230,319, 4,423,875 and 4,437,669.

The limited success achievable by devices of the type just described is believed to be attributable to the absence of physical sensory inputs. A golfer will mentally know when he or she has executed a putt well with such a device by visual observation and the absence of external force or shock. However, repetition without reliance on the aid is dependent on memory of the body movement that produces good putts. In other words, one must somehow recall and repeat a movement that was correct as measured by the absence of a physical input, i.e. feeling the stroke without contacting a guide.

Heretofore, such a positive sensory input has been provided by the golf club swing training device such as that disclosed in U.S. Pat. No. 3,953,035. That device provides means for slidably securing the shaft of a golf club to a rail supported above a playing surface, which rail extends along an ideal club swing path for short golf shots such as pitches and putts. By swinging the club slidably attached to the rail, the trainee may feel the club as it travels on an ideal path while being moved by the trainee. In this manner a positive sensory input is made.

Unfortunately, there are two serious problems associated with positive feedback training aids of the type just described. One is the lack of sufficient accommodation for individual of differing stature. In other words, only very limited adjustment is provided by the device to personalize it. The second limitation is the rigidity provided in actually coupling the club to the device. This makes for difficulty in making the transition from use of the aid to actual play, when the aid is no longer being used.

Accordingly, it is seen that were apparatus to be devised that could be used in a manner to provide some degree of positive input feel while retaining a balanced degree of swing freedom, a distinct advance in the art could be achieved. This would facilitate transition from aided practice to actual play. It is to the provision of such apparatus that the present invention is primarily directed.

The present invention differs from these and other prior art devices by introducing a slightly deformable, curved guide means, preferably in the form of a flexible guide plane, which the golfer can configure to his needs, and which serves to guide the putter shaft in a consistently repeatable manner.

SUMMARY OF THE INVENTION

In accordance with this invention, we have provided a simulator enabling a golfer to practice his or her putting skills and at the same time become more aware of the optimum motion of his shoulders during a putting effort.

our novel device is constructed so as to utilize a guide plane whose configuration can be carefully adjusted by the golfer, so as to enable the golfer to select his or her ideal stroke, and then be able to repeat it.

In the interests of minimizing verbiage, the description of this invention will in many instances utilize only the personal pronoun "he" and the possessive pronoun "his," but it is to be carefully understood that our device is equally applicable for use by female golfers.

As will be seen in ample detail hereinafter, our simulator comprises a guide means preferably in the nature of an elongate guide plane of flexible material having a mid portion as well as end portions, with this guide plane having an active edge, along which a lower portion of the shaft of a putter is intended to slide during putting efforts by the golfer. We place identifying numerals on the upper surface of the guide plane, with the zero mark being utilized at approximately the mid portion of the guide plane. The ball is placed on the ground in front of the zero mark of the guide plane.

So that the needs of a wide variety of different golfers may be met, we provide in the preferred embodiment of our invention, three separate means for supplying a desirable amount of individual support to the several portions of the guide plane. The support means we provide for the guide plane are readily adjustable heightwise, so as to enable the height of the mid and end portions of the guide plane above the playing surface to be individually and rapidly selected. As will be seen in greater detail hereinafter, the establishment of the height at each support location determines the positioning of the active edge of the guide plane with respect to the playing surface, with this positioning directly affecting the putter path inasmuch as the putter shaft is intended to move along the active edge.

It is of consequence to understand that at the time a golfer with a club in his hand bends over to some extent to address the ball, his shoulders should be in a parallel relationship to the ground, and reside in a plane that is perpendicular to the golfer's spine. This plane may be regarded as being inclined downwardly, to intercept the ground at some location in front of the golfer. Good golfing practice would recommend that the golfer maintain his shoulders in this inclined plane at all times during his stroke, meaning that arm movements should be accompanied by appropriate shoulder movement, for both rearward as well as forward motion.

Importantly, the novel guide plane of our stroke simulator is to be adjusted by the golfer until his movement of the shaft of the club along the active edge of the guide plane is entirely comfortable to him. The precise heightwise adjustments the golfer can make in the curvature of the guide plane enable him to find the curvature that is most suitable for his needs, and which will permit his shoulders to comfortably remain in the selected inclined plane throughout the entire putting stroke.

We have found that if the player is not concerned with follow-through, that is, motion of the club subsequent to ball contact, he will likely be tending to decelerate the face of the putter prior to impact with the ball, thus resulting in a poorly struck ball. We have therefore designed our novel guide plane such that the contouring of the guide plane forward of the ball impact point serves the very important function of training the golfer to maintain his shoulder movement in the aforementioned inclined plane that is most appropriate for his needs.

After the golfer has established the guide plane in the curvature most appropriate for his needs, he should then practice with the stroke simulator until he has trained his muscles to such an extent that his shoulders will remain in the selected inclined plane throughout his entire stroke.

A novel eye alignment mirror is utilized with our simulator, by the use of which the active edge of the guide plane may be brought into careful alignment with the line of sight to the cup. The eye alignment mirror also defines a location at which a ball to be putted to the cup may be consistently placed. This alignment mirror further enables the proper alignment of both the putter face and the golfer's eyes.

It is important to realize that the curved guide plane we prefer to use as the guide means for our novel golf practice device will permit the golfer to make settings appropriate for the particular type of putting stroke he or she desires to use. These different types of putting strokes are Straight Back to Straight Through, Inside to Square to Inside, and Inside to Square to Straight Through.

A golfer utilizing Straight Back to Straight Through must make a conscious effort to keep the face of the golf club square to the target line throughout the swing. In accordance with this preference, the two ends of the guide plane will be set higher than the center portion of the guide plane. The total amount of curvature for example will be greater than the golfer utilizing Inside to Square to Straight Through.

A golfer utilizing Inside to Square to Inside will likely place the guide plane in a more nearly horizontal attitude, with the front support in its lowest position. Although this technique has been known for a long time, and adherents to this technique are many, timing becomes very critical, and extra movements are required to keep the club face rotating open and then closed.

Golfers in ever increasing numbers are going to the technique known as Inside to Square to Straight Through, which entails less of a timing element, and involves a more consistent tilt of the shoulders. In using this particular technique, the shoulder closest to the cup becomes the fulcrum point, and the club face should be in line with a spot near the socket of this shoulder. As the golfer swings back, the fact that the fulcrum is not on the body's centerline causes the club head to come inside the target line on the backswing.

Continuing with a consideration of the Inside to Square to Straight Through technique, in mid swing the shoulders are back in the original starting position, and the club face is square with the intended target line, whereas on the forward swing, the shoulders rotate forward, remaining in the selected inclined plane. Since the fulcrum is closer to the target, the club head returns down the target line and does not move inside the target line. This particular technique involves the utilization of a comparatively steep slope of the guide plane during the forward swing, which directs the path of the club head along the target line. This technique is preferable to the others because it more nearly imitates a perfect pendulum putting stroke.

It is therefore a primary object of our invention to provide a teaching device that is highly adjustable, so as to be readily adaptable to every golfer's putting stroke.

It is a very important object of our invention to provide an adjustable putting stroke simulator enabling a golfer to establish his or her ideal putting stroke, and thereafter to continually practice that stroke in order to develop correct muscle memory.

More particularly, it is an important object to make the golfer aware of the need for him to keep his shoulders in an appropriately inclined plane throughout his stroke, with our novel guide plane being adjustable such that the golfer is assisted in maintaining his shoulders in this selected inclined plane throughout his entire putting stroke.

It is another very important object to provide an adjustable putting stroke simulator utilizing a slightly deformable, curved guide plane serving to guide the shaft of the putter in a consistently repeatable manner, such that the golfer will be taught to confine his shoulder movements to the selected inclined plane.

It is another important object of our invention to provide a very advantageous teaching device providing immediate feedback to the golfer as to the technique and the body positions he or she is using in putting by way of set lines and mirrors, thus enabling the golfer to develop consistency of swing.

It is yet another object of our invention to provide a teaching device enabling the golfer to adjust the path of the putter shaft, such that the putter head is caused to travel a desired path along the target line, thus traveling in a manner reflecting the individual preference of the golfer.

It is still another object of this invention to provide a training device enabling a golfer to set the guide plane of this novel device such that it will guide the shaft of the putter in such a way as to cause the putter head to travel a desired path along the target line.

it is yet still another object of our invention to provide a novel guide plane which can be carefully adjusted to meet the particular needs of a golfer, with the configuration of the guide plane enabling it to be bent in a manner appropriate to properly guide the shaft and therefore the head of the putter along the target line.

It is yet another object of our invention to provide a low cost, easy to use and readily transportable device serving to allow the golfer to capture a path for a putting stroke that works for him or her, with this device enabling the golfer to develop neuro-muscular memory—memory in the correct muscles, making proper backswings and forward swings second nature.

It is yet another object of our invention to provide a training device having a curved plane meeting an angled shaft, with the head of that shaft (the putter face) traveling in a path that is preferred by the individual golfer.

It is yet another object of this invention to provide an alignment mirror for facilitating the alignment of the golfer's eyes, the square position of the putter face in relation to the target line and an additional mirror on the base of the stroke simulator to facilitate the alignment and correct movement of the shoulders during the putting effort.

This invention differs from the prior art by introducing the slightly deformable, curved guide plane serving to guide the shaft of the putter in a consistently repeatable manner, further aided by the advantageous use of a unique mirror arrangement.

It is yet another object of our invention to provide a training device involving our novel stroke simulator that may be utilized without the alignment mirror, and by the use of which device, when set up properly and placed off the edge of the putting surface on an area called the fringe, the golfer may practice chipping his or her ball to the desired target.

These and other objects, features and advantages will be more apparent from a study of the appended text when considered in light of the drawings.

DETAILED DESCRIPTION

Figure 1:
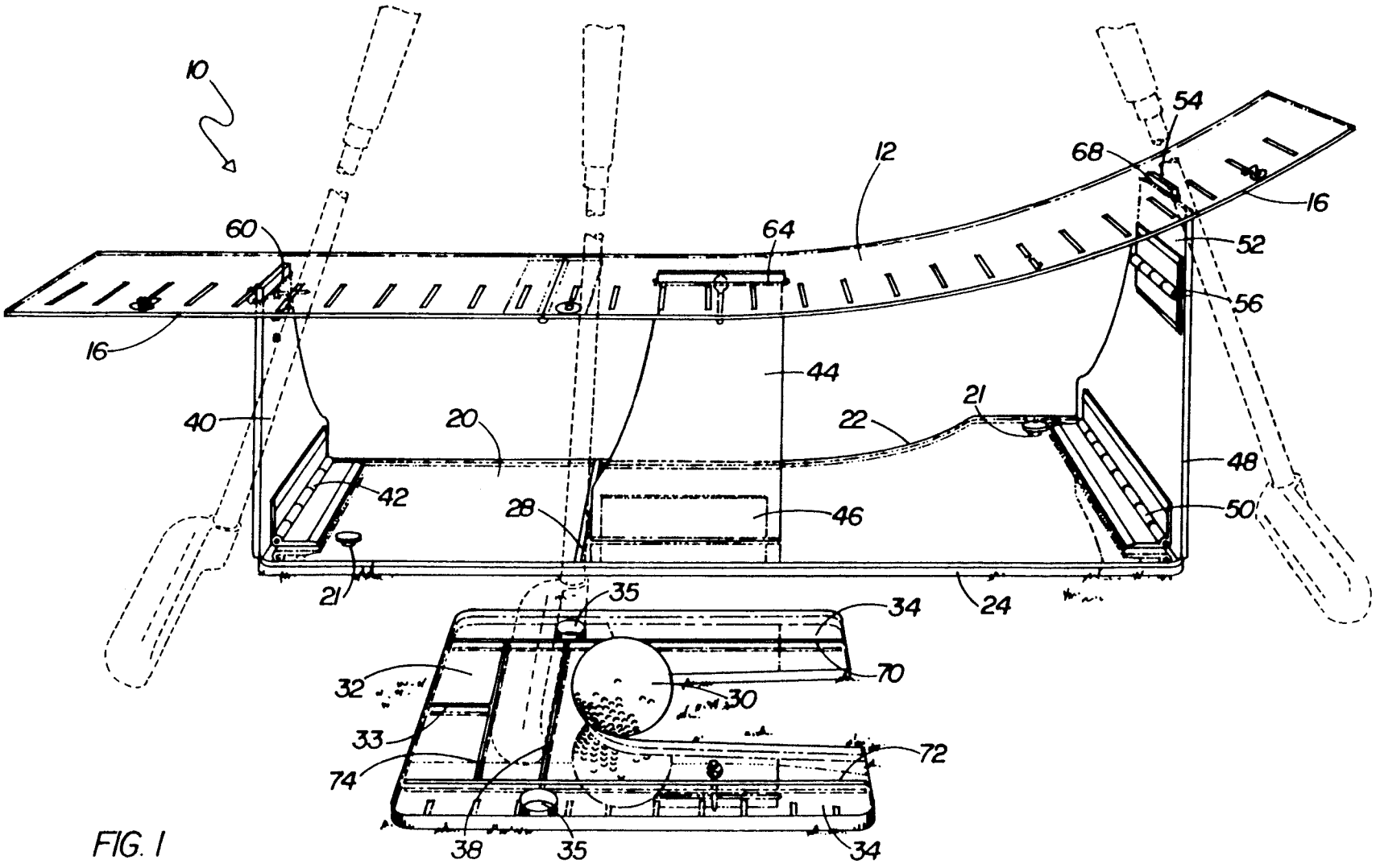
FIG. 1 is a perspective view of a preferred embodiment of our golf training device, revealing the elongate guide plane we prefer to utilize as the guide means that is utilized for guiding the path of swing of a putter, with this guide plane being supportable at several locations, and with the effective height of each support being readily adjustable.

With initial reference to FIG. 1, it will be seen that we have shown our novel stroke simulator 10 enabling a golfer to practice his or her putting skills and at the same time become more aware of the optimum motion of his or her shoulders during a putting effort. This novel simulator utilizes a guide means along which the shaft of a putter travels during putting efforts by the golfer. This guide means preferably comprises an elongate guide plane 12 of flexible material having an active edge 16 as well as a plurality of support locations. A support member of appropriate height for the guide plane is provided at each such location, each of which support members are hingedly attached to base member 20. To assure a desirable and sturdy relationship of the guide plane with the several support members, a slot of appropriate size is provided at each such location on the guide plane 12, such that the guide plane can be firmly yet removably attached to the upper portion of each support member. In accordance with this invention, the golfer is enabled to readily change the height of the guide plane at each support location, in a manner discussed at length hereinafter.

In the preferred embodiment, the base member 20 is made of reflecting material, so that the golfer can readily see the motion of his or her shoulders. This reflecting material can take the form of plastic silvered on one side to create a mirror, or a shiny, reflective surface. At least two holes 21 are provided in the base member such that at the right time, the golfer can anchor the base member to the ground. The holes 21 are each of a diameter closely matching the diameter of the shank of a golf tee, thus enabling the base member 20 to be held in the desired relationship to the putting cup by the use of two golf tees inserted into the holes 21 and into the ground.

The base member 20 is positioned in the most apt location with respect to the cup by means of a setup mirror 36 and an eye-alignment mirror 32, which are to be described shortly.

As viewed in FIG. 1, if the golfer were present, he or she would be standing on the far side of the device, with his or her toes close to the curved back edge 22 of the base member 20, and holding the golf club in such a position that a lower portion of the shaft of the club is in contact with the active edge 16 of the guide plane 12. As viewed in FIG. 1, the active edge 16 is of course on the far side of the guide plane 12 from the golfer, but the active edge is on the near side of guide plane 12 as viewed in this figure. It is to be understood that it is along the active edge 16 of the guide plane 12 that the lower portion of the shaft of the putter 18 moves during putting efforts by the golfer.

Also visible in FIG. 1 is an alignment mark 28 known as the base alignment line, that is provided on the base member 20, and the alignment mark 38 known as the putter alignment line, that is provided on the generally U-shaped eye alignment mirror 32. The marks 28 and 38 are provided on these members for purposes soon to be revealed.

Figure 2:
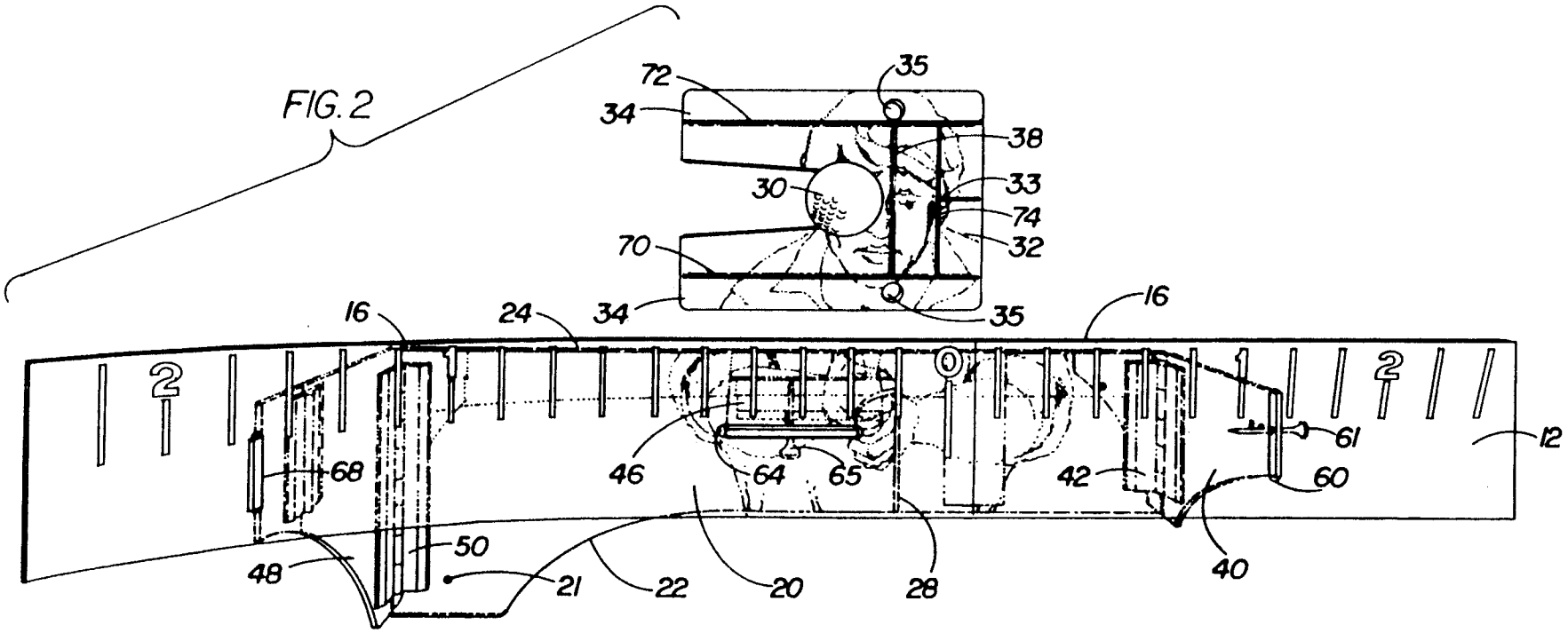
FIG. 2 is what may be regarded as a golfer's view of our novel training device, revealing what the golfer sees as he or she looks down upon the novel, flexible guide plane and upon the eye alignment device of reflective material used therewith.

In FIG. 2 it will be noted that we have placed Arabic numerals on the guide plane, with the "0" location corresponding to an at-rest position of the putter face, and a numeral "1" located to each side of the numeral "0" and several inches away. It will be seen that the numeral 1 to the right of the zero mark is closer to the zero mark than is the numeral 1 to the left thereof.

A golf ball 30 is shown resting between the arms 34 of the generally U-shaped eye alignment mirror 32 in FIG. 1, which is a reflecting device that forms an important part of the way our simulator is initially positioned with respect to the cup 26 (illustrated in FIG. 4) toward which the ball is to be putted. In other words, the eye alignment mirror 32 represents a distinct part of the means by which the active edge 16 of the guide plane 12 may be brought into careful alignment with the target line to the putting cup at a desired distance from the cup. The target line on the mirror 32 is represented by line 33; note FIGS. 1 and 2.

Although when putting on level ground, the target line is directed to the cup, it is to be understood that when on uneven ground, the target line represents the line along which the ball must be putted in order for it to reach and enter the cup.

To facilitate alignment of the base member 20 with the eye alignment mirror 32, we utilize, as previously mentioned, an alignment mark or putter alignment line 38 located on a rear portion of the mirror 32. It is to be noted that the eye alignment mirror 32 defines a location or space between the arms 34 at which the ball 30 to be putted to the cup may be placed.

Continuing with FIGS. 1 and 2, we prefer to refer to the eye alignment mirror 32 as being generally U-shaped, and to the arms 34 as being generally parallel, although it is true that the arms 34 are deliberately configured to diverge a bit, so as not to form a "chute" along which the ball can travel. In other words, if the arms 34 formed a slot having parallel sides, this might serve to direct the ball unerringly to the cup, thus to some extent defeating the purpose of the present device. Because we configure the arms 34 to diverge slightly, this permits the ball to roll in the actual direction in which it has been hit by the golfer, be it a correct or an incorrect direction, rather than the edges of the arms serving to correct the direction of travel of the ball, and cause it to go toward the cup.

Also visible in FIGS. 1 and 2 as being utilized on the eye alignment mirror 32 is the eye alignment line 70 provided for use by the right-handed golfer, and the eye alignment line 72 provided for use by the left-handed golfer. It will be further noted in these figures that we also provide a rear putter alignment line 74.

As will be set forth in greater detail hereinafter, we also prefer to use a setup mirror 36, to be seen in FIGS. 5 and 6. It will be noted that the mirror 36 is somewhat of a modified V-shape, that on occasion fits closely between the slightly divergent arms 34 of the generally U-shaped eye alignment mirror 32. A string 39 of stout construction approximately 9 feet long is utilized with the setup mirror 36, preferably being attached to the small end thereof; note FIG. 6. This string is utilized during the establishment of the target line to the cup.

Since a far larger percentage of golfers are right-handed rather than left-handed, the stroke simulator 10 depicted in FIGS. 1 and 2 is designed to be used by a right-handed golfer, with it to be understood that the cup into which the ball 30 is to be putted is to the right as viewed in FIG. 1, which is of course off the right hand edge of FIG. 1. This is entirely consistent with the direction in which a right-handed golfer putts the ball, which would be to the right as viewed in FIG. 1.

As is obvious, a putting stroke simulator in accordance with this invention intended to be utilized by a left-handed golfer would be a mirror image of FIG. 1.

Figure 3C:
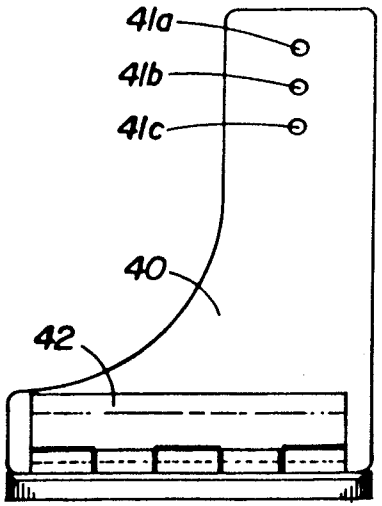
FIGS. 3*a*, 3*b* and 3*c* are related figures depicting the front support member, the center support member and the rear support member, respectively.

With continuing reference to FIG. 1, it is to be understood that rear support member 40, shown on the left hand side of FIG. 1, is supported upon the base member 20 by means of hinge 42, which is located adjacent to the rear portion of the base member. The hinge 42, also visible in FIG. 3*c*, is positioned so that the member 40 can be folded in the direction of the forward end of the device, such that it can rest flat against the base member 20 at the time the golfer has finished his practice and is ready to compact the simulator for insertion into its carrying case.

The center support member 44 is supported upon a mid portion of the base member 20 by means of a hinge member 46 (note FIG. 3*b*), which permits the center support member to be compacted by folding it away from the long edge 24 of the base member 20 nearest the ball. The front support member 48, shown on the right hand side of FIG. 1, is supported adjacent the front edge of the base member 20 by means of hinge 50, which permits the front support member to be folded toward the rear support 40 at the conclusion of the practice effort, and then lie flat against the base member 20.

Because our training device is designed to be used by golfers who use widely differing putting techniques, we utilize a foldable upper portion 52 of the front support member 48, so that either of two distinctly different heights for the front edge of the guide plane 12 can be selected. FIG. 1 reveals that we use an upper hinge 56 for the support of the upper portion 52, such that the golfer can either utilize the rectangularly-shaped uppermost part 54 of the upper portion 52 for supporting the forward end of the guide plane 12 (see FIG. 3*a*), or else fold down the upper portion 52, such that the forward end of the guide plane is supported directly by the rectangularly-shaped uppermost part 58 of the principal portion of the forward support member 48. We may refer to the part or member 58 as the lower front support.

Importantly, the support means we utilize are such that each portion of the elongate guide plane 12 can be supported at a selected height above a playing surface, or in other words, the height of the end portions of the guide plane 12 as well as the height of the mid portion of the guide plane above the playing surface can be individually selected and independently adjusted. This of course controls the positioning of the active edge 16 with respect to the playing surface, which therefore determines the path along which the lower part of the shaft of the club travels. More details of the manner in which the guide plane is supported by the various support members will be provided shortly, with particular reference to related FIGS. 3*a*, FIG. 3*b* and FIG. 3*c*.

It was previously mentioned that the alignment mark we prefer to call the base alignment line 28 is provided on an upper surface of the base member 20, which alignment line extends between the curved edge 22 of the base member nearest the golfer, and the straight edge 24 running the length of the base member. The alignment line 28 is perpendicular to the straight edge 24, and is to be used in conjunction with the putter alignment line or alignment mark 38 employed on the eye alignment mirror 32, as will be explained shortly. As previously mentioned, we prefer for the upper portion of the base member 20 to be a mirror surface, so that the golfer can see the position of his or her shoulders at the time of lining up the putter with the ball and during his or her stroke effort.

With reference now to FIG. 2, it is to be seen that this is a view taken from above, to reveal what the golfer sees as he or she looks down upon the flexible guide plane 12, the base member 20, and the eye alignment mirror 32. As previously mentioned in conjunction with FIG. 1, the ball 30 is shown resting at the innermost location between the arms 34 of the eye alignment mirror 32, which forms an important part of the way our simulator is initially positioned with respect to the cup toward which the ball is to be driven. At an appropriate time in the setup of our novel device for use, the base alignment line 28 on the base member 20 is to be brought into careful alignment with the putter alignment line 38 utilized on a rear portion of the eye alignment member 32.

The generally U-shaped eye alignment mirror 32 serves several specific needs, the first of these being that it contains indicia thereon, such that it may be used for establishing the target line, that is, the line the ball is to travel to the cup. The innermost point or apex of the slightly divergent arms 34 forms an ideal location in which to place the ball at the time the golfer is getting set to putt. For the purpose of this invention, we may from time to time refer to the configuration of the arms 34 as being generally parallel.

The mirror 32 also provides for proper eye alignment, and in addition enables the proper putter face alignment to be established. Lastly, this mirror provides a convenient reference point such that the proper relationship of the base member 20 to the target line can be established.

It is important to note in FIG. 2 that the straight edge 24 of the base member 20 is set back from the active edge 16 of the elongate guide plane 12. This recessing of the straight edge 24 from the active edge 16 is because some putters have head portions extending somewhat rearwardly from the putter shaft, and it obviously is desired that the support members 40, 44 and 48 be in a non-interfering relationship to the expected head motion of the putter used with our device. The golfer will often find the straight edge 24 of the base member to be of some help at the time he is endeavoring to align the base member 20 with the generally U-shaped eye alignment mirror 32. Because the edge 24 is perpendicular to the base alignment line 28, and the near edge of the mirror 32 is perpendicular to the putter alignment line 38, a noticeable parallel relationship between the edge 24 of the base member and the near edge of the mirror 32 can be a degree of help in assuring the golfer that he has properly aligned the mark 28 of base member 20 with the alignment line 38 of the mirror 32.

To enable the elongate guide plane 12 to be secured in an appropriate manner on the support members 40, 44 and 48, we utilize three carefully placed rectangularly shaped slots of a particular size in the guide plane, these being visible in FIG. 1, but seen in clearer detail in FIG. 2.

On FIG. 2 is revealed a rectangular slot 60 utilized near the rear end of the elongate guide plane 12, which rectangular slot is designed to closely receive the rectangularly-shaped upper portion of the rear support member 40, the latter member being depicted in FIG. 3c. Also shown in FIG. 2 is slot 64, which is a rectangular slot designed to receive the rectangularly-shaped upper end of the center support member 44 depicted in FIG. 3b, and the slot 68, which is a rectangular slot designed to be utilized in conjunction with the previously-described front support member 48. The front support member is of course depicted in FIG. 3a.

As previously mentioned, the front support member 48 is designed to have a foldable upper portion 52, which can be utilized in the manner shown in FIG. 1, in which the rectangularly-shaped uppermost portion 54 is received in the slot 68 in the guide plane 12. As an alternative, the upper portion 52 can be folded down such that a rectangularly-shaped lower front support member 58, disposed on the principal portion of the front support member 48, is in contact with the slot 68 provided in the elongate guide plane, for the support of same.

As indicated in FIG. 2, we prefer to utilize a golf tee 61 to hold the rear edge of the guide plane 12 in a desired relationship to the rear support member 40, and a golf tee 65 to hold the central portion of the guide plane in a desired relationship to the center support member 44.

Figure 3B:
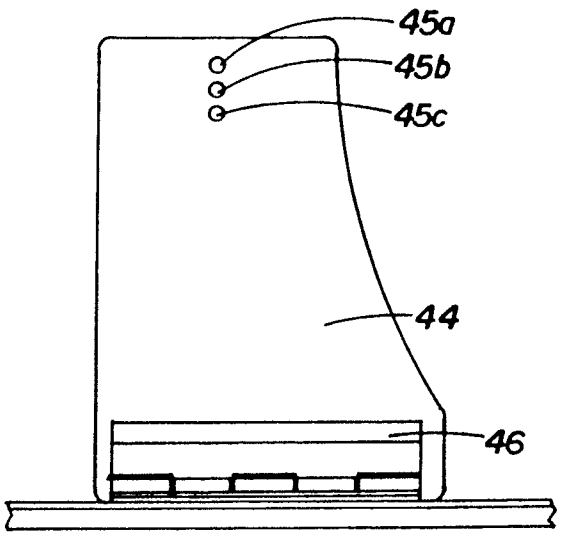
Figure 3A:
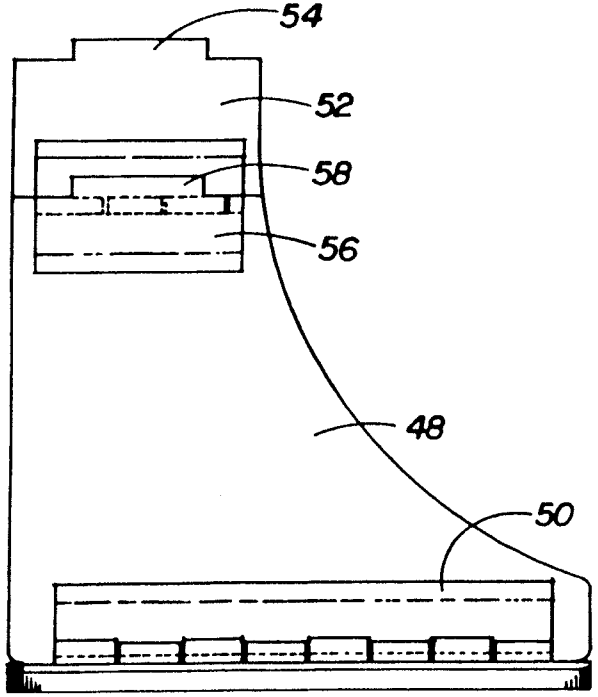

With reference now to related FIGS. 3a, 3b and 3c, it will be noted that in FIG. 3a, the foldable upper portion 52 is shown supported by upper hinge 56. The uppermost part 54 of member 52 is shaped to be of a precise rectangular configuration, so as to be relatively closely received in the slot or notch 68 provided in a front portion of the elongate guide plane 12, as noted from FIGS. 1 and 2.

It is to be noted in FIG. 3a that we have indicated a rectangularly-shaped portion 58 provided on an upper part of front support member 48 which, as previously mentioned, we prefer to call the lower front support 58. This arrangement enables the front slot 68 to be closely received on the upper part of the front support member 48 itself in the event the upper portion 52 has been folded down into what may be regarded as an out-of-use position. Whether the slot 68 is engaged by the rectangularly-shaped portion 54 of the upper member 52, or the rectangularly-shaped lower front support 58, a rather close fit is involved.

With reference now to FIG. 3b, it will be seen that in center support member 44 we have provided three holes 45a, 45b, and 45c. These holes are disposed in a vertical alignment, with each of these holes being of a diameter such as to closely receive the body portion of the golf tee 65, in the manner shown in FIG. 2. As will be mentioned hereinafter, the beginning golfer will typically place the golf tee 65 in the center hole 45b in the first instance, with the understanding being that he or she may subsequently decide to move the golf tee 65 to either the upper hole 45a or the lower hole 45c. The hole in the center support member 44 appropriate for use in a given instance is usually determined by the angle of the putter shaft, known as the "lie."

Turning to FIG. 3c, it will be noted that the rear support member 40 is provided with three holes 41a, 41b and 41c, into any one of which the rear golf tee 61 may be inserted. The beginning golfer will usually place the tee 61 in the center hole 41b in the first instance, and then later possibly decide to place the tee in either the upper hole 41a or the bottom hole 41c.

As will be noted from FIG. 1, the typical golfer will utilize the elongate guide plane 12 in a position in which the center portion is lower than the forward portion of the guide plane, or in other words, the guide plane is ordinarily curved downwardly in the center. For this reason, the golf tee 65 is typically inserted into the selected hole of the center support member 44 at a location above the guide plane 12. As a consequence, the tee 65 serves to hold the center portion of the guide plane 12 in a downwardly curved configuration. The holes in the middle support 44 are provided to accommodate putters with differing lie angles, as previously indicated.

Because shoulder members are associated with both the upper portion 54 and the lower front support 58 of the front support member 48, and those shoulder members are larger (longer) than the front slot 68 of the guide plane, the guide plane cannot in either instance slip downwardly into an out-of-position location.

With regard to the rear support member 40 depicted in FIG. 3c, the golf tee 61 is usually mounted in the selected hole of the member 40 at a location below the guide plane 12, for in view of the fact that the golf tee 65 typically holds the center portion of the guide plane in a downward position, the golf tee 61 is depended upon to support the rear end of the guide plane 12 at a desired height.

It was previously indicated that the active edge 16 of the elongate guide plane 12 must be brought carefully into a parallel relationship with the target line, and to enable this to be accomplished in the most accurate manner, we prefer to utilize the previously-mentioned setup mirror 36. As viewed in FIGS. 5 and 6, the setup mirror has a straight centerline 37 running the length of the middle portion of this mirror, and it is along this centerline that the string 39 is caused to extend during the setup procedure, when the target line to the cup is being established.

Figure 4:
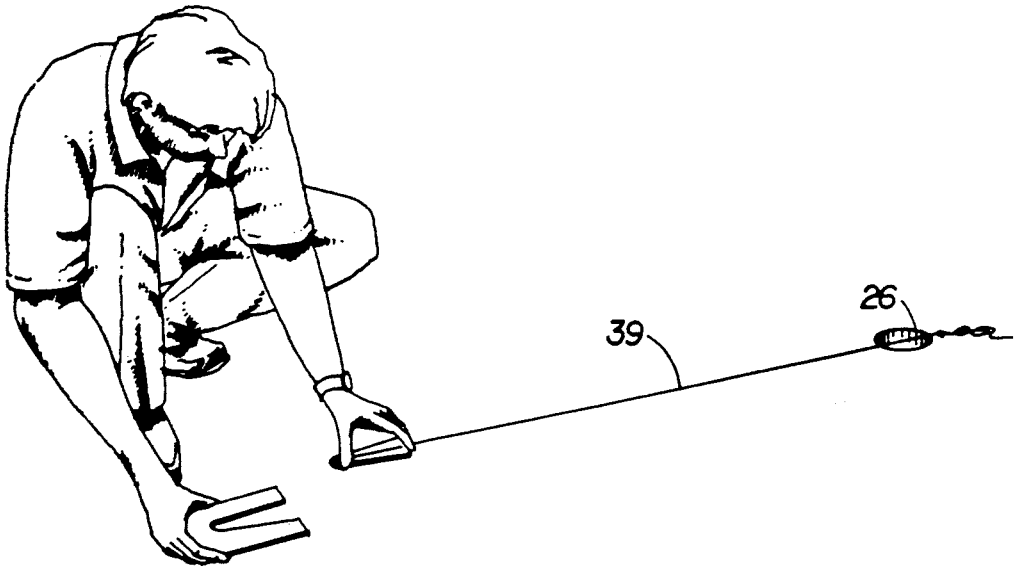
FIG. 4 is a view showing a string attached to the setup mirror, extending to a position behind the cup.

In the use of our device, and with reference to FIG. 4, it will be seen that the golfer is stretching the string 39 between the cup 26 and a position a desired number of feet away from the cup. To readily permit this to take place, we provide loops at certain locations on the string 39, with these loops preferably being at the three foot, the six foot and the nine foot locations. With continuing reference to FIG. 4, a tee is pushed into the ground on the far side of the cup 26, with an appropriate loop on the string 39 then hooked around this tee. It is recommended that the beginning golfer should set the stroke simulator 10 at a location six feet from the cup 26, meaning of course that the loop located at the six foot mark on the string 39 be hooked around the tee.

The string 39 is now stretched so as to place the setup mirror 36 at a location under the string at a distance of approximately six feet from the cup. The golfer then carefully straightens the mirror 36 until the string 39 extends across the centerline 37 of this mirror.

Figure 5:
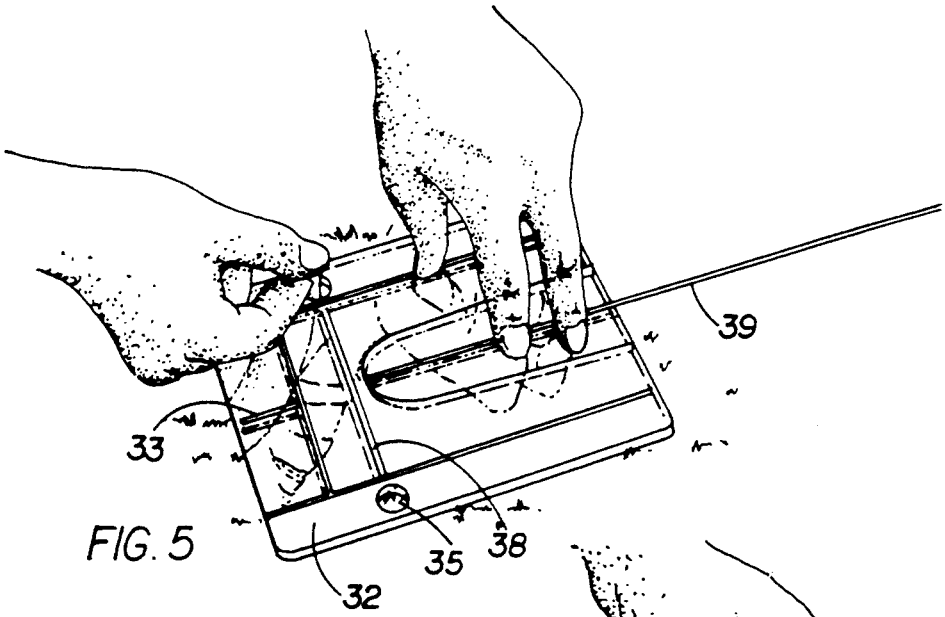
FIG. 5 is a view showing a golfer placing the arms of the eye alignment mirror around the setup mirror, so as to establish the eye alignment mirror in a desired relationship to the putting cup.
Figure 6:
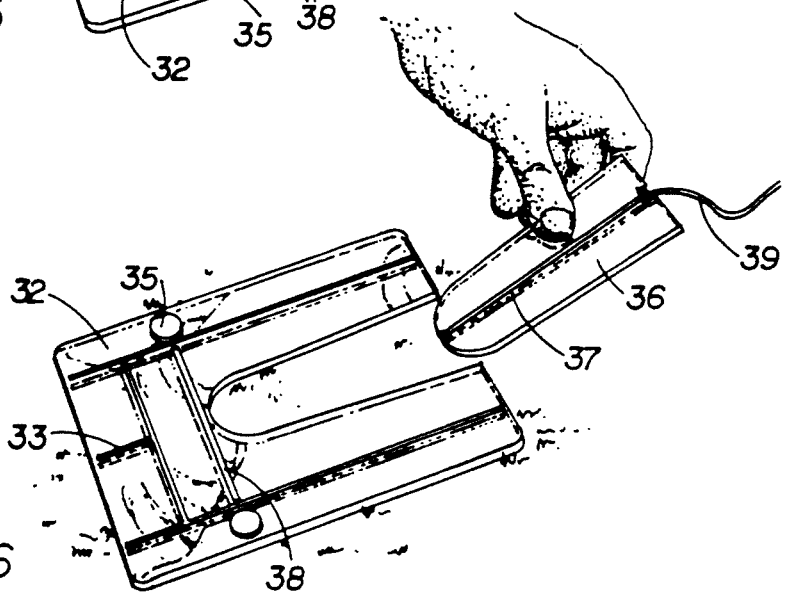
FIG. 6 is a view illustrating the golfer removing the setup mirror, which is to be retained for future use.

Holding the setup mirror 36 in this carefully aligned position, the golfer then proceeds, in the general manner shown in FIG. 5, to slide the eye alignment mirror 32 in place around the setup mirror 36, that is, with the arms 34 of the mirror 32 straddling the setup mirror 36. As is obvious, we configure the arms 34 of the mirror 32 to fit closely around the mirror 36. At this point the golfer carefully anchors the eye alignment mirror 32 to the ground by inserting a golf tee into each hole 35 located in the eye alignment mirror 32. Each of these holes is of a diameter equal to the head of the tee. Each tee should be pressed down firmly into the ground so that the top of each tee is flush with the top surface of the alignment mirror 32, in close-fitting engagement with the respective hole 35. The eye alignment mirror 32 will now be firmly located in a position in which the portion of the mirror 32 between the arms 34 as well as the target line 33 of this mirror are each accurately directed toward the cup 26. With the mirror 32 secured, the setup mirror 36 can be removed, as shown in FIG. 6, and the string 39 wrapped around this mirror for future use.

For indoor use, a different arrangement for anchoring the eye alignment mirror 32 may be utilized, which may for example use Velcro. Preferably we install hook-type Velcro on the bottom of the eye alignment mirror 32, which may be effective to grip the surface (typically carpet) upon which this mirror is used.

With the positioning of the generally U-shaped mirror 32 in a carefully aligned relationship to the cup 26 now having been established, it is necessary to assemble our novel stroke simulator 10. This is accomplished by lifting the rear support member 40, the center support member 44 and the front support member 48 into the erect positions, preparatory to the tops of these members receiving the guide plane 12 thereon. Golf tees are used to support the guide plane in the desired relationship to the rear and central support members, utilizing the previously-described procedure.

At this point the golfer moves the base member 20 of our simulator into an appropriate position with respect to the mirror 32, and more particularly, he or she moves the alignment mark 28 located on the base member 20, into precise alignment with the alignment mark 38 located on the eye alignment mirror 32. At this time of careful alignment, the active edge 16 of the elongate guide plane 12 is directed parallel to the target line.

Because the long front edge 24 of the base member 20 is perpendicular to the alignment mark 28 on the base member, and the near edge of the eye alignment mirror 32 is perpendicular to the alignment mark 38 on the mirror 32, the golfer will often note, as he goes about aligning the mark 28 with the mark 38, whether or not the front edge 24 of the base member appears to be parallel with the near edge of the eye alignment mirror 32.

It is important to realize that many different putter configurations are in use today, which may mean that when a golf ball has been placed at the innermost point or apex of the slightly divergent arms 34 of the eye alignment mirror 32, and the face of the putter brought into an operative relationship to the ball, the shaft of the putter may dictate that the active edge 16 of the guide plane 12 be several inches away from the line of sight between the ball and the cup. This in turn dictates that the straight edge 24 of the base member 20 be out of direct contact with the near edge of the eye alignment mirror 32, but the alignment mark 28 on the base member is nevertheless to be in careful alignment with the alignment mark 38 located on a rear portion of the eye alignment mirror 32.

The base member 20 may continue to reside in a location in which the two alignment marks 28 and 38 are in parallel relation without anchoring it, but it is likely that the golfer will find it desirable to proceed to anchor the base member 20 firmly to the ground by the use of tees inserted in a close-fitting manner through the carefully sized holes 21. The holes 21 are provided, as previously mentioned, at spaced locations in the base member 20.

The guide plane 12 is now to be installed in an appropriate height relationship to the support members 40, 44 and 48 by the previously-described procedure, so that the active edge 16 of the elongate guide plane 12 will have a contour appropriate for the individual golfer.

Regarding the setup of the elongate guide plane 12, it is recommended that a novice begin by setting the guide plane in the standard heightwise setting which, as previously mentioned, involves the use of the upper portion 52 of the front support member 48; the middle hole 45*b* of the center support member 44; and on the rear support member 40, the middle hole 41*b*, which is marked with a blue square. This is the standard setting of Inside to Square to Straight Through.

Next the golfer should place the now assembled stroke simulator into close proximity with the alignment mirror 32. However, it may be necessary that the golfer make a final adjustment to properly align the stroke simulator. The golfer should stand in the area which is behind the base mirror 20. The putter is placed on top of the alignment mirror 32, so that the front edge of the putter face is in line with the putter alignment line 38, and the center of the putter face (the sweet spot) is in line with the target line. Holding the putter in the proper position, the base member 20 of the stroke simulator is then moved into final position so that the active edge 16 is just touching the shaft of the putter and the long edge 24 of the base member 20 is parallel to the target line 33 on the alignment mirror 32.

Depending on the preference of the golfer, his eyes can be either directly over the ball or else within an area some two inches inside the ball, this being in the direction toward his feet. The eye alignment line 70 on the mirror 32 will usually be of considerable help to the right-handed golfer at this time. If the golfer is left handed, then the eye alignment line 72 will be of considerable help in enabling the golfer to address the ball carefully.

Starting at the position marked "0", the golfer now slides his or her putter shaft back and forth along the active edge 16 of the guide plane 12 in such a manner as to keep the shaft of the putter in continuous contact with the active edge 16 of the guide plane. This should cause the ball to be guided to the cup, presuming of course that the golfer has hit the ball neither too hard nor too easily. By way of swinging the club, the novice should begin by sliding the shaft of the club back to the "1" located on the right side of the zero point, and then swing the club forwardly to the "1" mark located on the left of the zero mark. The numerals on the guide plane are placed so as to take into consideration that the forward stroke is somewhat longer than the back stroke, which fact is responsible for promoting proper acceleration of the putter through the ball.

When the novice feels adept at swinging the putter in this manner, he or she should then make the same stroke again, but this time gliding the shaft back to the "2", and then moving it forwardly to the "2" located at the far left of the guide plane, as seen in FIG. 2.

If the golfer does not find Inside to Square to Straight Through to be comfortable, he or she can place the tee in the top hole of the rear support, and permit the front support to remain in the full upright position. This will result in the use of the technique known as Straight Back to Straight Through.

As a third option, the golfer may place the tee in the middle hole of the rear support, and fold the upper portion 52 of the front support into the downwardly directed position. This will result in using the technique known as Inside to Square to Inside.

As previously mentioned, the angle of the putter shaft (the lie) determines the setting of the middle support 44. Since most putters have a standard lie, the middle hole, which we regard as the "standard" hole, is usually the most appropriate one. However, we provide other settings for the middle support 44, for golfers who prefer a putter with either a flat or upright lie.

The typical golfer will find that with the ball resting in the innermost point or apex of the arms 34 of the eye alignment mirror 32, the ball position should be approximately 2" inside the left heel. The left eye should be directly in line with the ball, and the forearms and feet are parallel to target line. The palms of the hands should face each other for a balanced grip, and 60% of the golfer's weight should be on his or her left leg, presuming that he is a right-handed golfer. The knees should be bent and the golfer should lean forward, keeping his or her back straight and assuming a well-balanced, half-seated position. The eyes should be directly over or else slightly inside of the ball. In this latter instance, the eyes would be above the right hand eye alignment line 70. The hands should be slightly ahead of the ball, and the putter face perpendicular to the target line. The arms and shoulders should be relaxed.

All of the features mentioned above serve as reference points which allow the golfer to practice one particular stroke he or she desires over and over again.

The result of this practice is the key to this invention; that of building a highly repetitive putting stroke and therefore developing memory in the appropriate muscles. With our novel device, the golfer develops confidence as well as a feel for making solid contact with the ball.

Figure 7:
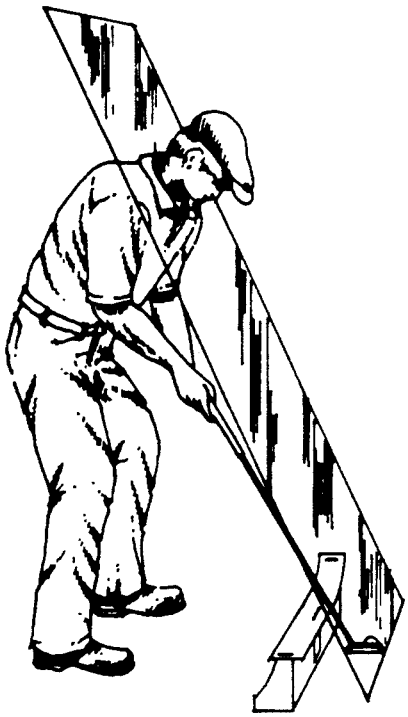
FIG. 7 is a view illustrating the comparatively shallow plane of the shoulders of a golfer utilizing the putting technique known as Inside to Square to Inside, wherein the shoulder plane angle is generally about 65°.

With reference now to FIG. 7, it will be noted that this is a view illustrating the comparatively shallow plane of the shoulders of a golfer utilizing the putting technique known as Inside to Square to Inside, wherein the plane angle is generally about 65°. In order to develop consistency of swing, the golfer should strive at all times to maintain his shoulders in this plane.

Figure 8:
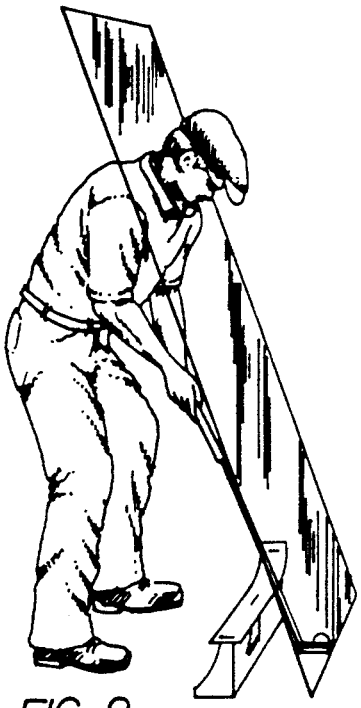
FIG. 8 is a view illustrating the standard plane of the shoulders of a golfer utilizing the putting technique known as Inside to Square to Straight Through, wherein the shoulder plane angle is generally about 70°.
Figure 9:
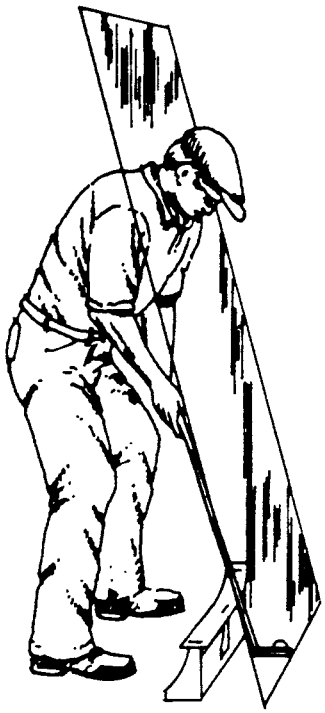
FIG. 9 is a view illustrating the comparatively steep plane of the shoulders of a golfer utilizing the putting technique known as Straight Back to Straight Through, wherein the shoulder plane angle is generally about 75°.

FIG. 8 is a view illustrating the standard plane of the shoulders of a golfer utilizing the putting technique known as Inside to Square to Straight Through, wherein the plane angle is generally about 70° and FIG. 9 is a view illustrating the comparatively steep plane of the shoulders of a golfer utilizing the putting technique known as Straight Back to Straight Through, wherein the plane angle is generally about 75°.

Now with regard to the other major aspects of this invention, it is to be understood that our novel stroke simulator can also be used as a highly effective training device for that area of golf concerning the short chip-and-run, i.e. a chip from about five feet off the edge of the putting surface, and thus approximately thirty feet from the cup. It is necessary for the golfer, in performing this particular golf shot, to create enough loft on the trajectory of the golf ball as to make it land on the putting surface and roll the rest of the distance to the hole or target.

To help the golfer develop a highly repetitive chip-and-run stroke which causes the shaft of the club to travel along the slightly curved guide plane and the club head to travel from slightly inside the target line to square (the Ball) to slightly inside on the followthrough, it is necessary to set up the stroke simulator the following way:

The golfer should first establish a spot about five feet from the edge of the putting surface, so as to be some thirty feet from a given hole or target. The golfer should then place the stroke simulator on the selected spot so that the active edge of the guide plane will be parallel to the target line. The golfer will then adjust the stroke simulator so that the foldable upper front support member 52 is in the down position, such that the lower front support member 58 engages the front slot 68 of the guide plane 12. The middle support and the rear support members are set in their standard positions.

The ball to be chipped is placed in position in line with the tee holding the middle portion of the guide plane. The golfer then places his or her club directly behind the ball with the shaft resting in contact with the active edge of the guide plane. The golfer should stand so that his or her right foot is in line with the alignment line on the base mirror. While keeping the club in contact with the guide plane, the golfer should glide the shaft back to the position on the guide plane marked by the arabic numeral "2," then glide the club forward, striking the ball and continuing the stroke so that the shaft travels beyond the front end of the glide plane and on toward the hole or cup.

It has previously been mentioned that by the base member 20 having a reflective upper surface, the golfer can readily see whether or not his shoulders are moving in a desirable manner, whereas by the use of the reflective surface of the mirror 32, the golfer can see his own eyes and establish a desired relationship to the ball. It is within the spirit of this invention to construct the eye alignment mirror 32 to be relatively larger than depicted in the figures of drawing of this case, thus to permit the golfer to observe the motion of his shoulders in the mirror 32.

It should now be apparent that we have developed a highly effective simulator providing novel guide means for a putter shaft, which guide means can be readily adjusted so as to present the proper configuration for every putting technique utilized by golfers. With the proper use of our device, the golfer will be able to establish his or her ideal putting stroke, and thereafter to continually practice that stroke in order to develop correct muscle memory.

We claim:

1. A simulator enabling a golfer to practice his putting skills and at the same time become more aware of the optimum motion of his shoulders and arms during a putting effort, said simulator comprising an elongate guide plane of flexible material having a mid portion as well as end portions, said guide plane having an active edge, along which a lower portion of the shaft of a putter may pass during efforts by the golfer to putt a golf ball into a nearby cup, and means for supporting said guide plane at a selected height above a playing surface, said supporting means for said guide plane being adjustable, so as to enable the respective heights of said mid and end portions of said guide plane above the playing surface to be independently adjusted, which at the same time determines the positioning of said active edge with respect to the playing surface.

2. The simulator recited in claim 1 in conjunction with an alignment mirror adapted to placed on the playing surface, which alignment mirror contains indicia enabling it to be placed on the target line to the cup, with said alignment mirror thereafter being used in placing said active edge of said guide plane in a parallel relation to the target line.

3. The simulator recited in claim 2 in which said alignment mirror is generally U-shaped, involving spaced, essentially parallel arms between which the golf ball to be putted is placed, said alignment mirror also containing a putter alignment mark enabling the golfer to carefully line up the face of his putter in a perpendicular relationship with the target line to the cup.

4. The simulator recited in claim 3 including a setup mirror utilized for establishing the positioning of said alignment mirror, said setup mirror being configured to fit within the arms of said alignment mirror before the placement of the golf ball therebetween, said setup mirror utilizing means for establishing the target line to the cup, the latter means including a string that can be stretched from the cup to the location where the simulator is to be placed.

5. The simulator recited in claim 1 in which a zero mark is placed in a mid portion of the active edge of said guide plane, this mark indicating the position at which the ball to be putted is placed.

6. The simulator recited in claim 5 in which said guide plane is used in conjunction with an alignment mirror adapted to be placed on the playing surface, said alignment mirror containing indicia, and with respect to such indicia, said zero mark on said active edge of said guide plane is placed during the lineup of said active edge with the target line to the cup.

7. A simulator enabling a golfer to practice his putting skills and at the same time become more aware of an optimum motion of his shoulders and arms during a putting effort, said simulator comprising an elongate guide plane of flexible material having a mid portion as well as end portions, said guide plane having an active edge, along which a lower portion of the shaft of a putter may pass during putting efforts by the golfer, and means for supporting said guide plane at a selected height above a playing surface, said supporting means for said guide plane being adjustable, so as to enable the respective heights of said mid and end portions of said guide plane above the playing surface to be independently adjusted, which at the same time determines the positioning of said active edge with respect to the playing surface, and an eye alignment mirror utilized with said simulator, by means of which said active edge of said guide plane may be brought into a desired relationship with the target line to the cup, said eye alignment mirror defining a location at which a ball to be putted to the cup may be placed.

8. The simulator recited in claim 7 in which said alignment mirror contains indicia thereon, enabling the golfer to align the face of his putter in a perpendicular relationship to the target line.

9. The simulator recited in claim 8 including a setup mirror utilized for establishing the positioning of said alignment mirror, said setup mirror being configured to fit within the arms of said alignment mirror before the placement of the golf ball therebetween, said setup mirror utilizing means for establishing the target line to the cup, the latter means including a string that can be stretched from the cup to the location where the simulator is to be placed.

10. A simulator enabling a golfer to practice his putting skills and at the same time become more aware of an optimum motion of his torso during a putting effort, said simulator comprising an elongate guide plane of flexible material having a mid portion as well as end portions, said guide plane having an active edge, along which a lower portion of the shaft of a putter may pass during putting efforts by the golfer, and means for supporting said guide plane at a selected height above a playing surface, said supporting means for said guide plane involving a base member, upon which three separate supporting components are hingedly mounted, which supporting components may be folded into a flat relationship to said base member when said guide plane is no longer being used, the effective height of each of said supporting components being independently adjustable so as to enable the respective heights of said mid and end portions of said guide plane above the playing surface to be individually selected, which at the same time determines the positioning of said active edge with respect to the playing surface.

11. The simulator recited in claim 10 in conjunction with an alignment mirror adapted to be placed on the playing surface, which alignment mirror contains indicia enabling it to be placed on the target line to the cup, with said alignment mirror thereafter being used in placing said active edge of said guide plane in a parallel relation to the target line to the cup.

12. The simulator recited in claim 11 in which said alignment mirror is generally U-shaped, involving spaced, essentially parallel arms between which the ball to be putted is placed, said alignment mirror also containing a putter alignment mark enabling the golfer to place the face of his putter in a perpendicular relationship with the target line to the cup.

13. The simulator recited in claim 12 including a setup mirror utilized for establishing the positioning of said alignment mirror, said setup mirror being configured to fit within the arms of said alignment mirror before the placement of the golf ball therebetween, said setup mirror utilizing means for establishing the target line to the cup, latter means including a string that can be stretched from the cup to the location where the simulator is to be placed.

* * * * *